US006467208B1

(12) United States Patent
Patterson

(10) Patent No.: US 6,467,208 B1
(45) Date of Patent: Oct. 22, 2002

(54) PIVOTABLE OVERHEAD LIGHTED EXIT SIGN

(76) Inventor: David Patterson, 509 Eleventh Ave., Mays Landing, NJ (US) 08330

( * ) Notice: Subject to any disclaimer, the term of this patent is extended or adjusted under 35 U.S.C. 154(b) by 11 days.

(21) Appl. No.: 09/710,934

(22) Filed: Nov. 13, 2000

(51) Int. Cl.[7] ..... G09F 13/04

(52) U.S. Cl. ..... 40/570; 40/564; 248/900; 362/812

(58) Field of Search ..... 40/564, 570, 572, 40/580, 608, 617, 642.02, 492; 248/289.1, 291.1, 479, 495, 900; 362/812

(56) References Cited

U.S. PATENT DOCUMENTS

| | | | | |
|---|---|---|---|---|
| 735,946 A | | 8/1903 | Coleman et al. | |
| 1,148,341 A | | 7/1915 | Spencer | |
| 2,994,148 A | | 8/1961 | Endelson | |
| 3,931,689 A | | 1/1976 | Shine | |
| 4,561,203 A | | 12/1985 | MacDonald, Jr. et al. | |
| 5,022,627 A | | 6/1991 | Beghelli | |
| 5,048,210 A | | 9/1991 | Taylor et al. | |
| 5,233,773 A | * | 8/1993 | Reynolds | 40/661.03 |
| 5,376,020 A | * | 12/1994 | Jones | 439/537 |
| 5,572,819 A | | 11/1996 | Topinka et al. | |
| 5,636,462 A | * | 6/1997 | Kleiman | 40/452 |
| 5,664,749 A | | 9/1997 | Kump et al. | |
| 5,796,331 A | | 8/1998 | Lamparter | |

FOREIGN PATENT DOCUMENTS

| | | | | |
|---|---|---|---|---|
| GB | 2117955 | * | 10/1983 | 40/564 |
| GB | 2226682 | * | 7/1990 | 40/570 |

* cited by examiner

*Primary Examiner*—Brian K. Green
(74) *Attorney, Agent, or Firm*—Norman E. Lehrer

(57) ABSTRACT

An overhead lighted exit sign and mounting includes a substantially rectangular box shaped sign housing with an electric light therein. A substantially cylindrically shaped two part hollow hinge is mounted on the top wall of the housing with one part fixed to the housing. The second part of the hinge is secured to a plate adapted to be secured to an overhead electrical box. Apertures are formed in the top wall of the housing, the two parts of the hinge and the plate to allow electrical wires to pass from the electrical box to the electric light within the sign without being exposed. The hinge allows the sign to pivot out of the way in the event that it is struck by an object being carried therebelow without the sign being broken from its support or otherwise being damaged.

1 Claim, 2 Drawing Sheets

PIVOTABLE OVERHEAD LIGHTED EXIT SIGN

BACKGROUND OF THE INVENTION

The present invention is directed toward an exit sign and, more particularly, toward a lighted overhead exit sign which is mounted in such a way so as to pivot out of the way if struck to avoid being broken.

Exit signs are widely used in numerous public buildings in order to identify exits and guide patrons to those exits in the event that it is necessary to leave a building because of a fire or other emergency. Frequently these exit signs are illuminated so that they will be visible in the dark in the event that power is interrupted to the building's lighting system. The illuminated exit signs normally have an auxiliary power source separate and apart from the main power source feeding the building's lights. In fact, this is mandated by code in most jurisdictions.

Many illuminated exit signs are mounted flush against a wall in the vicinity of the exit and are frequently visible from a significant distance. However, in hotels, office buildings and the like which may have long corridors, a single exit sign located in the vicinity of an exit may not be visible from remote locations at the other end of a corridor. In such situations, it is common to mount overhead illuminated exit signs at various positions along the length of the corridor.

Conventionally, illuminated exit signs that are mounted overhead are first rigidly mounted to a mounting plate or the like which, in turn, is secured to an electrical box secured to or within the ceiling of the corridor. Such arrangements are shown, for example, in U.S. Pat. Nos. 2,994,148; 3,931,689 and 4,561,203. If the ceiling is relatively high, the illuminated exit signs are of a sufficient height above the ground so as not to interfere with the movement of people, equipment or the like through the corridor. Unfortunately, in many situations, the exit signs can be easily broken, thereby increasing the cost of repair and maintenance thereof and, obviously, decreasing the safety factor of their ability to guide patrons to an exit.

One type of establishment where overhead lighted exit signs are frequently damaged is in a hotel, motel or the like. Hotels, for example, normally have corridors with standard ceilings of approximately seven to eight feet. An exit sign mounted to the ceiling might then extend downwardly to a height of six to seven feet. Housekeeping is frequently moving mattresses or other pieces of furniture through the corridors to places where they are needed. It is not uncommon for a mattress that is being moved on a cart or dolly or the like to strike the overhead exit sign, breaking the same or ripping the sign from its ceiling mount.

While it is recognized that overhead signs have been proposed in the past that are capable of pivoting such as shown in U.S. Pat. Nos. 735,946 and 5,664,749, these are not illuminated signs and, therefore, are not faced with the problem of providing electrical power to the signs disclosed therein while still allowing them to pivot. There is, therefore, a need in the art for an overhead lighted exit sign that can pivot out of the way if struck rather than becoming damaged.

SUMMARY OF THE INVENTION

The present invention is designed to overcome the deficiencies of the prior art discussed above. It is an object of the present invention to provide a lighted overhead exit sign which is, mounted in such a way so as to pivot out of the way if struck to avoid being broken.

It is another object of the invention to provide a pivotable overhead lighted sign that is wired to an electrical box without the wires being exposed.

It is a still further object of the invention to provide an overhead lighted sign that is not easily damaged to thereby increase safety and convenience while reducing repair and maintenance costs.

In accordance with the illustrative embodiments demonstrating features and advantages of the present invention, there is provided an overhead lighted exit sign and mounting that includes a substantially rectangular box shaped sign housing with an electric light therein. A substantially cylindrically shaped two part hollow hinge is mounted on the top wall of the housing with one part fixed to the housing. The second part of the hinge is fixed to a plate adapted to be secured to an overhead electrical box. Apertures are formed in the top wall of the housing, in each of the two parts of the hinge and in the plate to allow electrical wires to pass from the electrical box to the electric light within the sign without being exposed. The hinge allows the sign to pivot out of the way in the event that it is struck by an object being carried therebelow without the sign being broken from its support or otherwise damaged.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
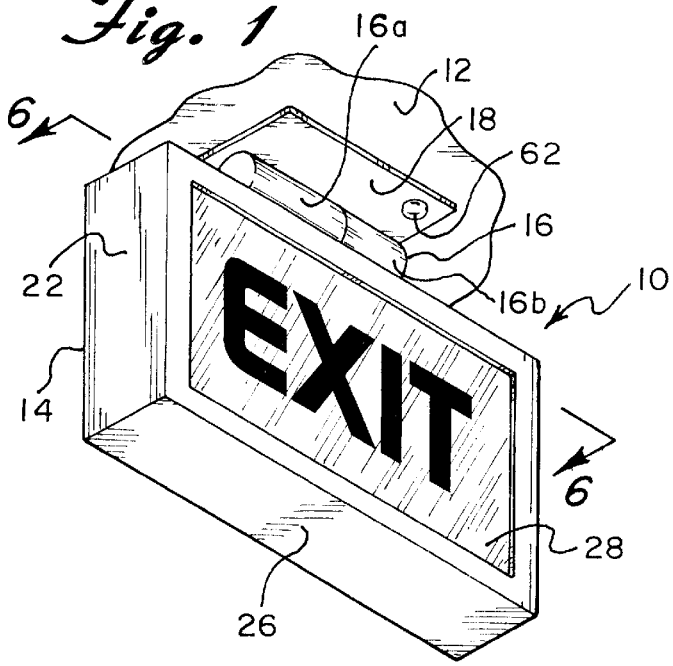
FIG. 1 is a perspective view of the lighted overhead exit sign of the present invention pivotally mounted to a ceiling.
Figure 2:
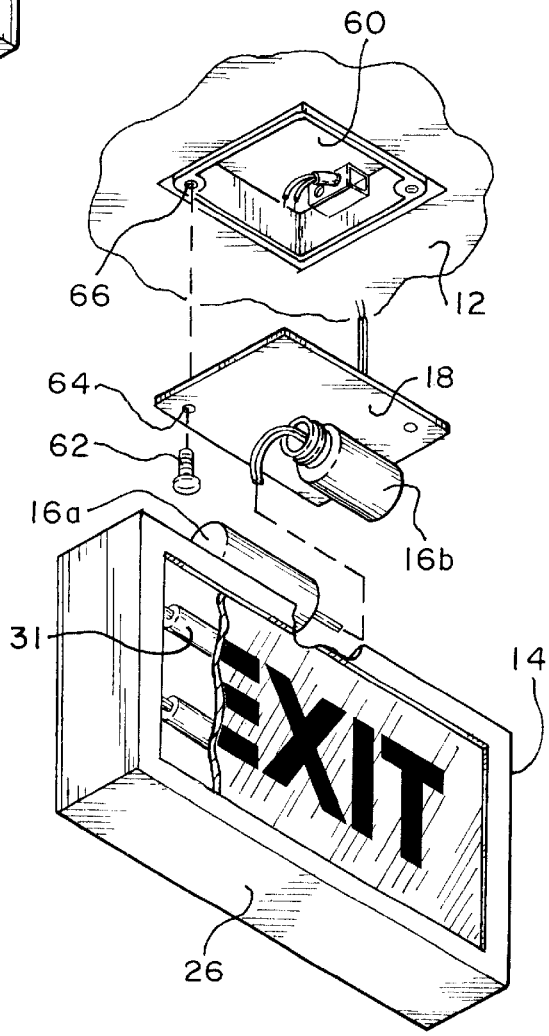
FIG. 2 is an exploded view of the invention shown in FIG. 1.
Figure 3:
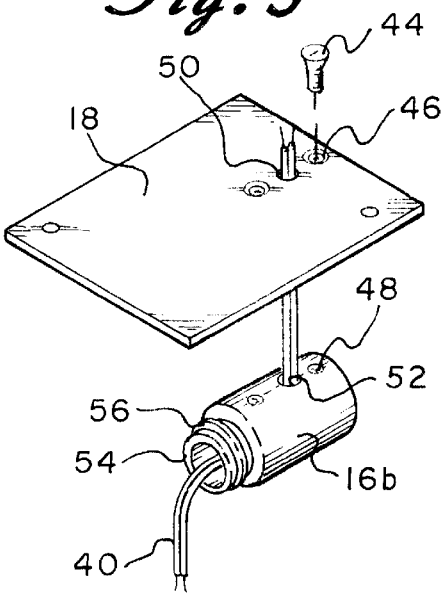
FIG. 3 is a partial exploded view showing the details of the upper portion of the sign mounting.

Referring now to the drawings in detail wherein like reference numerals have been used throughout the various figures to designate like elements, there is shown in FIG. 1 an overhead lighted exit sign and pivot mount constructed in accordance with the principles of the present invention and designated generally as 10. The sign and mount 10 are shown secured to a ceiling 12 that may be in the corridor of a hotel or the like.

The overhead lighted exit sign and pivot mount 10 of the invention are comprised essentially of a sign 14 and the pivot mount comprised of a hinge 16 and a plate 18. The sign 14 is of a conventional construction of substantially rectangular box shape having a top wall 20, side walls 22 and 24 and a bottom wall 26. The front and back faces of the sign 14 include translucent lenses 28 and 30 with the word EXIT printed thereon. Within the body or interior of the sign 14 is an electric light 31 which can be an incandescent light, a fluorescent light or substantially any other type of illuminating means known in the art.

Figure 4:
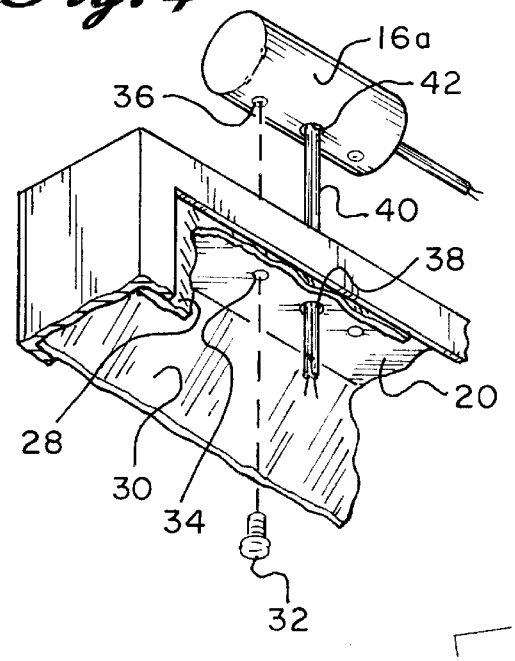
FIG. 4 is a partial exploded view showing the details of the lower portion of the sign mounting.

Secured to the top wall 20 of the sign 14 is a first half 16*a* of the cylindrically-shaped hollow hinge member 16. As shown most clearly in FIGS. 4 and 6, hinge half 16*a* is secured to the top wall 20 through the use of screws 32 that pass through apertures 34 and 36 in the top wall 20 and in the cylindrical wall of the hinge half 16*a*. The top wall 20 of the sign 14 also includes an aperture 38 therein through which electrical wires 40 may pass into the interior of the sign. A similar aperture 42 is formed in the outer wall of the first cylindrically-shaped hinge half 16*a* so that the electrical wires 40 can pass into the interior thereof as shown best in FIG. 6.

The second hinge half 16*b* is similarly secured to the plate 18 through the use of screws 44 that pass through aperture 46 in the plate 18 and are screwed into the opening 48 in the hinge half 16*b*. Further apertures 50 and 52 are formed in the plate 18 and hinge half 16*b* respectively to allow the electrical wires 40 to pass therethrough.

Figure 5:
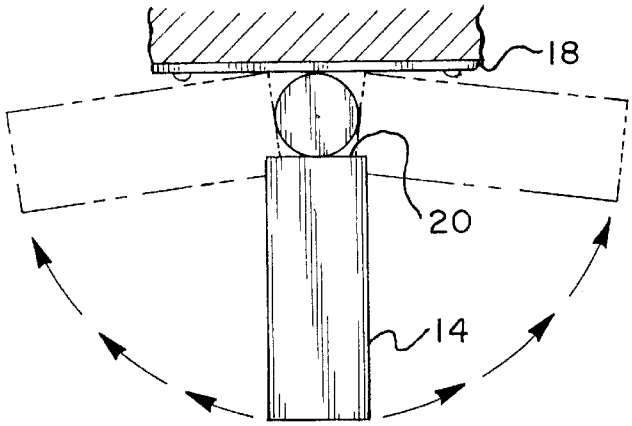
FIG. 5 is an end view of the invention illustrating the pivotal movement of the sign.
Figure 6:
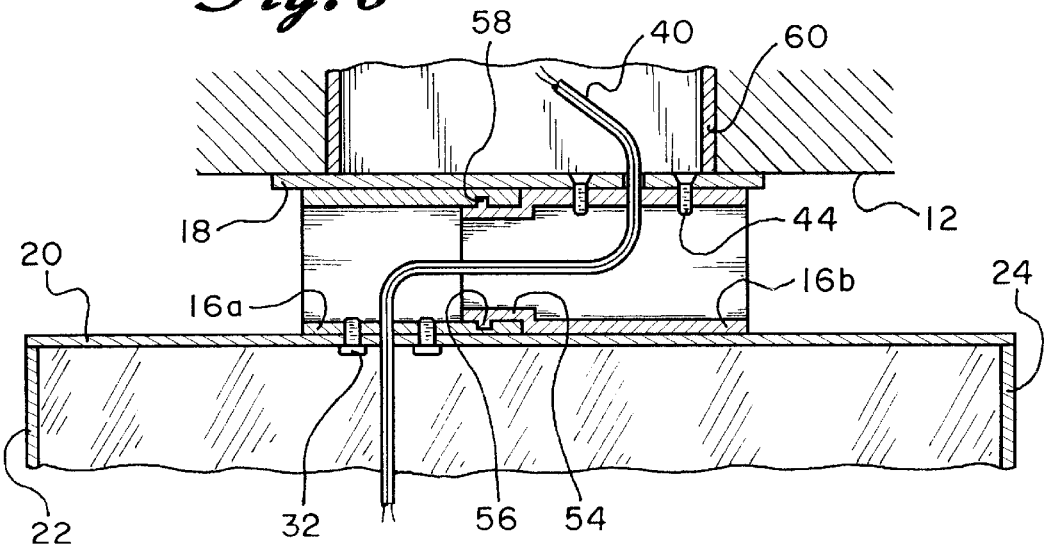
FIG. 6 is a partial cross-sectional view of the sign of the present invention taken through the line 6—6 of FIG. 1.

As best seen in FIG. 6, the first and second hollow hinge halves 16*a* and 16*b* are secured together in pivotal or rotational fashion. This is accomplished by the second hinge half 16*b* having a reduced forward portion 54 with a raised annular ring 56 attached thereto that is adapted to snap into a cooperating annular recess 58 in the first hinge half 16*a*. As a result, the two hinge halves are concentrically arranged and cannot be easily separated in the axial direction. However, they are free to pivot with respect to each other as shown in FIG. 5.

With the overhead lighted exit sign and pivot mount 10 assembled in the manner described above, the plate 18 can then be secured to the electrical box 60 mounted in the ceiling 12. This is done in a conventional manner utilizing screws 62 that pass through aperture 64 in the plate 18 and are screwed into the screw holes 66 in the electrical box 60.

In its normal position, the exit sign 14 extends vertically downwardly and is essentially 90° from the ceiling 12. In the event that it is pushed or bumped from the front or back, it is capable of pivoting upwardly in order to move out of the way. As shown best in FIG. 5, the sign 14 is capable of moving in either direction through an arc of substantially 180°. That is, it can move so as to be substantially parallel to the ceiling on either side of the hinge 16. Thus, rather than break off and become damaged, the sign 14 will merely pivot out of the way in the event that it is bumped.

The present invention may be embodied in other specific forms without departing from the spirit or essential attributes thereof and accordingly, reference should be made to the appended claims rather than to the foregoing specification as indicating the scope of the invention. By way of example and not limitation, although the invention has been described in connection with an exit sign, it should be understood that the invention applies equally to substantially any overhead lighted sign that may be subject to being struck.

I claim:

1. An overhead lighted sign and mounting comprising:

a substantially rectangular box shaped sign having a top wall with an aperture therein, an electrically operated illuminating means within said sign and an electrical wire passing through said aperture into the interior of said sign for connection to said illuminating means;

a substantially cylindrically shaped hollow hinge comprised of a first cylindrical member and a second cylindrical member secured together in axial alignment so as to pivot relative to each other, each of said first and second cylindrical members having an aperture in a wall thereof passing from the outside to the interior of said member;

said first cylindrical member being fixedly secured to said top wall with said wire passing through said aperture in said wall of said first member into the interior thereof;

a plate adapted to be secured to an overhead electrical box, said plate having an aperture therein for said wire to pass through, and said second cylindrical member being fixedly secured to said plate with said wire passing through said aperture in said wall of said second member from the interior thereof to the exterior and through said aperture in said plate for connection to said electrical box.

* * * * *